US007927204B2

(12) United States Patent
DeBrabander, Jr. et al.

(10) Patent No.: US 7,927,204 B2
(45) Date of Patent: Apr. 19, 2011

(54) SLOT GAMING DEVICES AND METHODS

(75) Inventors: Michael L. DeBrabander, Jr., Kenosha, WI (US); Paul G. Dussault, Barrington, IL (US)

(73) Assignee: GC2, Inc., Arlington Heights, IL (US)

( * ) Notice: Subject to any disclaimer, the term of this patent is extended or adjusted under 35 U.S.C. 154(b) by 826 days.

(21) Appl. No.: 11/753,672

(22) Filed: May 25, 2007

(65) Prior Publication Data

US 2008/0220839 A1 Sep. 11, 2008

Related U.S. Application Data

(60) Provisional application No. 60/893,549, filed on Mar. 7, 2007.

(51) Int. Cl.
*A63F 9/24* (2006.01)

(52) U.S. Cl. ..... 463/16; 463/17; 463/18; 463/20

(58) Field of Classification Search ..... 463/16, 463/17, 18, 20

See application file for complete search history.

(56) References Cited

U.S. PATENT DOCUMENTS

| | | | | |
|---|---|---|---|---|
| 6,413,162 | B1 * | 7/2002 | Baerlocher et al. | 463/20 |
| 6,896,617 | B2 * | 5/2005 | Daly | 463/20 |
| 7,108,602 | B2 | 9/2006 | Daly | |
| 7,128,647 | B2 | 10/2006 | Muir | |
| 7,160,187 | B2 | 1/2007 | Loose et al. | |
| 2004/0048646 | A1 | 3/2004 | Visocnik | |
| 2004/0077404 | A1 * | 4/2004 | Schlottmann et al. | 463/30 |
| 2004/0127282 | A1 * | 7/2004 | Naobayashi | 463/20 |
| 2004/0219969 | A1 * | 11/2004 | Casey et al. | 463/20 |
| 2005/0060050 | A1 * | 3/2005 | Baerlocher | 700/92 |
| 2005/0071023 | A1 * | 3/2005 | Gilliland et al. | 700/91 |
| 2006/0030387 | A1 | 2/2006 | Jackson | |
| 2006/0052152 | A1 | 3/2006 | Tedsen et al. | |
| 2006/0068873 | A1 | 3/2006 | Gomez | |
| 2009/0131145 | A1 * | 5/2009 | Aoki et al. | 463/20 |

FOREIGN PATENT DOCUMENTS

WO 2007005846 A2 1/2007

* cited by examiner

*Primary Examiner* — Dmitry Suhol
*Assistant Examiner* — Brandon Gray
(74) *Attorney, Agent, or Firm* — Lewis and Roca LLP

(57) ABSTRACT

Methods and systems for providing a video slot machine game of chance are provided herein. A video slot machine may use M-reels to play an N-reel game, where M>N, or may use any field of play larger than necessary to determine a payout outcome of the game. For example, nine reels may be used to play a multi-line five reel video slot game. The reels may be selected by an N-reel wide frame that slides back and forth over the available reels. In some embodiments, reels on one side of the screen pay at a higher rate than reels on the other side of the screen, or pay rates of reels gradually increase or decrease from one end of the visually displayed reels to the other. Optional bonus modes may take advantage of all M reels, e.g., by sliding the frame across the reels without respinning the reels and recalculating pay lines, by providing free spins with the frame locked in place, and/or by moving the frame to a highest paying position for one or more free spins.

21 Claims, 15 Drawing Sheets

SLOT GAMING DEVICES AND METHODS

This application claims priority to provisional application Ser. No. 60/893,549, filed Mar. 7, 2007, having the title "Slot Gaming Device and Methods," herein incorporated by reference.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The invention relates generally to games of chance, slot machines, and video gaming machines. More specifically, the invention provides various methods and systems for a game of chance illustratively embodied in a video slot machine, whereby the game selects a subset of available reels to determine an outcome of the game.

BACKGROUND OF THE INVENTION

Gaming establishments (e.g., casinos) rely heavily on slot machines and video gaming devices as a substantial source of income. In regulated gaming jurisdictions, e.g., Las Vegas, Nev., gaming regulations dictate the minimum levels that a video gaming device must pay out, as a percentage of money wagered by players playing the machine, e.g., 90% minimum. Thus, if a machine is said to pay 95%, then the machine pays at least $0.95 in winnings for every $1.00 wagered in the machine. While the profit ratio appears slim, casinos principally rely on the volume of money played for their profits. Because each video gaming machine can be considered a relatively fixed cost (maintenance and IP licenses represent minimal ongoing costs), the more money played in each machine, the more a casino's profits.

As the popularity of video slot machines (video gaming) grows, and more games are offered in the marketplace, video slot/gaming developers must provide innovative game play and/or payout methodology to maintain player interest in a given video gaming machine. Further, in order to maximize profit, casinos are continually seeking new and innovative games to keep players' interest, lest the player wander off into someone else's casino. Thus, there is a continual need in the art to provide new game play methods, bonuses, mini-games, payout methodology, and the like, in video gaming devices.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

To overcome limitations in the prior art described above, and to overcome other limitations that will be apparent upon reading and understanding the present specification, aspects of the present invention are directed to a video gaming machine (e.g., video slot machine) and method relating to the same that increases game volatility by using an increased number of reels. A device and associated method provide a slot machine game that receives a line wager from a player of the slot machine, where the line wager includes a number of lines and a wager amount per line. The slot machine graphically depicts an M-reel game on a display of the slot machine, where $M \geqq 2$, and each reel has a plurality of discrete indicia thereon. The slot machine determines a final position corresponding to each of the M reels, spins each of the graphically depicted M reels on the display, and stops each of the graphically depicted M reels at the corresponding final position. The slot machine automatically selects N reels from the M reels, where $1 \leqq N < M$, and determines a payout outcome of the game based on the line wager and based on a comparison of the indicia displayed on each of the selected N reels to a predefined pay-table. Other aspects or embodiments might not be limited to the aforementioned limitations on N and M, e.g., where the frame moves vertically instead of horizontally, the frame is non-rectangular, or any other embodiment or aspect where the playable field of indicia is larger than a frame identifying a subset of the playable field.

In one illustrative embodiment, nine reels may be utilized to play a five reel video slot game, referred to herein as a 5-9 embodiment. M may be any quantity larger than five in a five reel game, or any number larger than N in an N-reel game. Further, according to other embodiments, other numbers of reels may be used. According to an illustrative 5-9 embodiment, all nine reels are displayed on the screen at all times, while a five reel wide frame, which may further include attached pay line indicators, floats over the top of the reels and may stop at a random left/right position during each spin. In one embodiment, reels on one side of the screen pay at a higher percentage than a standard percentage (or at a higher percentage than the reels on the other side of the screen) while reels on the opposite side of the screen pay at a lower percentage.

According to one or more illustrative aspects, the game play may be similar to a known 3×5 line based video slot game, with the addition of the selection of five reels from a greater number of available reels. The player may select the number of lines to play and the bet per line. When the game starts, all nine reels begin spinning and the five-reel-wide game frame begins to slide left and right. As indicated above, the frame may stop randomly on any one of the 5 left to right positions in the illustrative 5-9 embodiment, and then the reels stop. Alternatively, the frame may have a higher likelihood of stopping on higher paying reels or lower paying reels based on a player's wager. The game may then pay all line wins. Symbols that fall outside of the 5-reel-wide game frame are inactive and do not contribute to game pays, except as otherwise indicated herein (e.g., as part of a bonus and/or a scatter).

Further illustrative aspects of the invention may include bonuses. According to one aspect, the leftmost/highest paying reel may include a bonus initiator symbol or indicia that, when appearing on the reel and the reel is active, the game frame locks on the left-most position and the game spins a predetermined number of free spins, e.g., five.

In yet another embodiment, the right-most/lowest paying reel may include a bonus (Free Slide Bonus) initiator symbol or indicia that when it appears on the reel and the reel is active the game pays as normal, then a bonus mode moves the frame left one reel, the game pays, the frame moves left again, etc., until the game pays with the frame encompassing the left-most positioned reel. Of course, one skilled in the art will appreciate that these, variations of these, and other bonus features may be incorporated in one or more other locations and/or manners.

Another aspect of the invention provides a computer readable medium, video slot machine, and corresponding method that determines a wager outcome of a video slot machine based on only a portion of an entire field of play of the slot machine. A representative method may perform a video slot gaming method by identifying a field of play of a video slot machine, where the field of play comprises a plurality of field locations, and where each field location is configured to host at least one symbol selected from a predefined set of symbols. The slot machine method determines a wager by a player of the video slot machine, automatically selects a proper subset of the field locations and, for each field location of the proper subset of field locations, quasi-randomly selects a symbol from the predefined set of symbols to be hosted by the field location. The slot machine graphically depicts each field location of the proper subset of field locations as hosting its corresponding selected symbol on a display of the video slot machine, and the slot machine determines a wager outcome based on the symbols hosted by each field location of the proper subset of the field locations.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
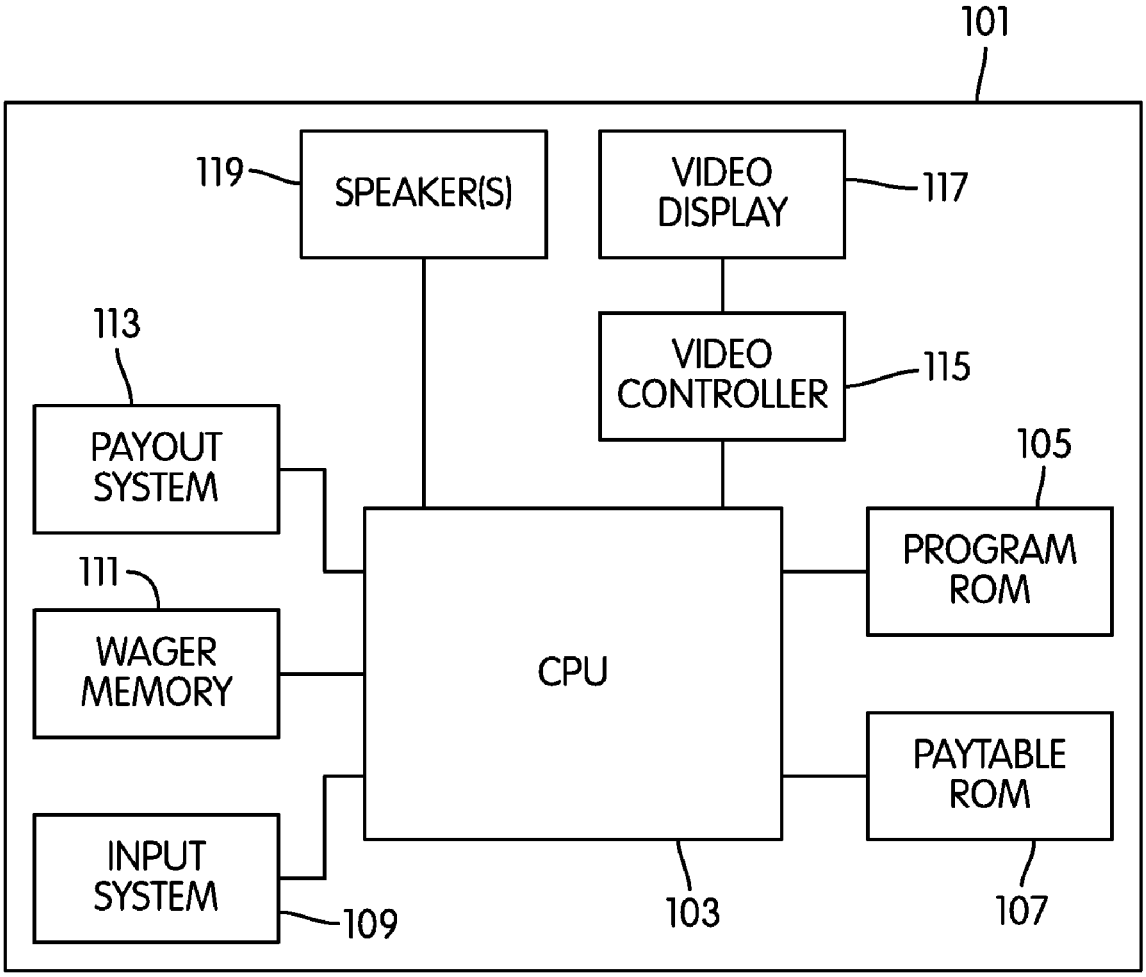
FIG. 1 illustrates an example of a hardware architecture in which one or more aspects of the invention may be embodied.

FIG. 1 provides an example of a hardware architecture in which one or more aspects of the invention may be embodied. Video gaming device 101 may be, for example, a video slot machine, such as is found in any gaming jurisdiction. Video gaming device 101 may include a CPU 103 controlling overall operation of the video gaming device based on instructions stored in program ROM 105 and pay-table ROM 107. Program ROM 105 stores executable instructions describing the behavior of the video gaming device, to be executed by CPU 103 to control operation of video gaming device 101. Pay-table ROM 107 stores payout information based on various outcomes of the video gaming device. The pay-table and/or pay-table information may alternatively be stored in other memory. ROMs 105 and 107 may be combined in a same or different physical memories.

CPU 103 may be connected to a video controller 115, which provides visual output to one or more video displays 117. CPU 103 may also provide audio output through one or more speakers 119. Audio and video output may vary depending on the specific manner and method in which aspects of the invention are embodied in video gaming device 101, as will be appreciated upon reading further details below and with reference to the figures.

Input system 109 may include one or more buttons, toggles, switches, levers, coin/token slots, paper money/ticket receivers, magnetic card reader, touch-sensitive display screen(s) and the like, through which a player can deposit money (real or play money/tokens may be used) into the video gaming device 101, review help and instructional information, select wager amounts, select pay lines, start a game, make selections during a game (e.g., in a bonus round), decide to cash out, etc. Wager memory 111 stores a current amount of money deposited by or credited to the player in video gaming device 101, and may also store current wager information input by the player, e.g., base wager amount, number of lines played, bet per line, etc. Payout system 113 may include a coin/token dispenser, paper money/ticket dispenser, or any other device through which a user can withdraw money from video gaming device 101.

Video gaming device 101 is for purposes of illustration only. As used herein, the term "video gaming device" or "slot machine" may refer to any data processing device, whether a computer, video slot machine, mechanical slot machine, mobile telephone, personal digital assistant, MP3 player, and the like, on which a game of chance performing as described herein may be stored, implemented, and/or executed. For example, one or more aspects of the invention may be embodied in computer-usable data and computer-executable instructions, such as in one or more program modules, executed by one or more computers or other devices. Generally, program modules include routines, programs, objects, components, data structures, etc. that perform particular tasks or implement particular abstract data types when executed by a processor in a computer or other device. The computer executable instructions may be stored on a computer readable medium such as a hard disk, optical disk, removable storage media, solid state memory, ROM, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the invention, and such data structures are contemplated within the scope of computer executable instructions and computer-usable data described herein.

Traditional slot machines provide the same total number of reels as are used to determine an outcome regarding whether a player of the slot machine wins or loses. Thus, if a traditional slot machine has three reels, then the outcome of each game played on that slot machine is determined based on the symbols or indicia presented on all three reels; if a traditional slot machine has four reels, then the outcome of each game played on that slot machine is determined based on the symbols presented on all four reels; if a traditional slot machine has five reels, then the outcome of each game played on that slot machine is determined based on the symbols presented on all five reels; etc. Traditional slot machines may thus be referred to at N-to-N reel games, or N-N games. Aspects of the present invention provide a video game of chance that increases game volatility by using an increased number of reels than are used to determine an outcome of each game played on the game of chance. Thus, aspects of the present invention may be referred to as N-to-M reel games, or N-M games, where an integer $M \geqq 2$ represents the total number of reels, and an integer N represents a number of reels used to determine an outcome of a given game of the game of chance, where $1 \leqq N < M$. M is preferably (but need not be) at least five, and in a preferred embodiment is at least nine. Also, greater differences between N and M may provide more dynamic game play and variability. Other aspects or embodiments might not be limited to the aforementioned limitations on N and M, e.g., where the frame moves vertically instead of horizontally, the frame is non-rectangular, or any other embodiment or aspect where the playable field of indicia is larger than a frame identifying a subset of the playable field.

Figure 2:
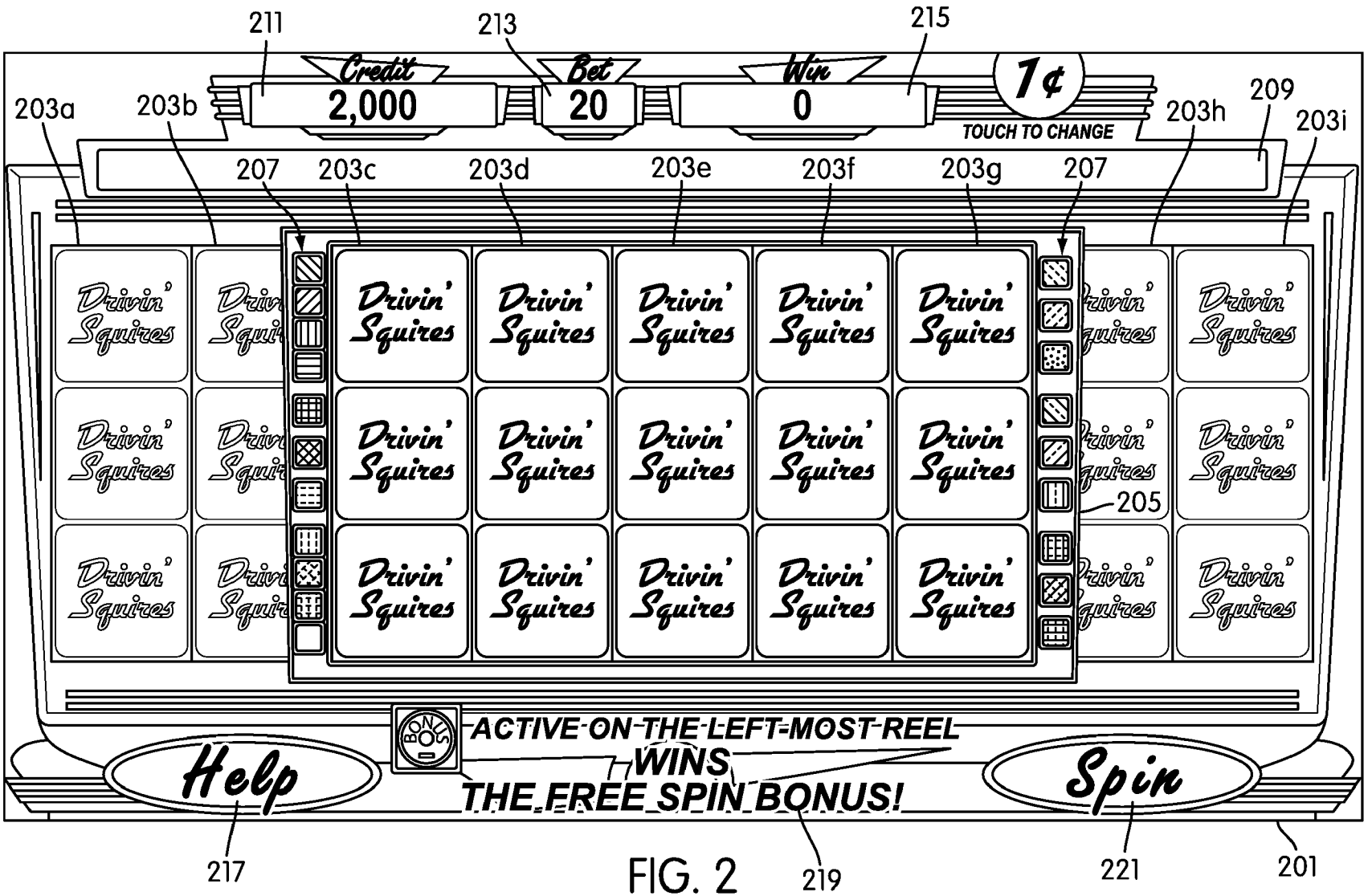
FIG. 2 illustrates an initial screen display of a video game of chance according to an illustrative embodiment.

In an illustrative embodiment, with reference to FIG. 2, M=9 and N=5. That is, nine reels 203*a*-203*i* may be utilized to play a five reel video game of chance, or video slot machine, referred to herein as a 5-9 embodiment. FIG. 2 illustrates an initial screen 201 of a game of chance according to an illustrative embodiment. The number of reels may be any quantity larger than five in a five reel game, or any number larger than N in an N-reel game. Further, according to other embodiments, other numbers of N and M reels may be used. According to the illustrative 5-9 embodiment, all nine reels 203*a*-203*i* may be displayed on the screen at all times, while a five-reel-wide frame 205, which may further include pay line indicators 207, visually appears to float over the top of reels 203 and may stop at a random position during each spin (i.e., a random left/right position). Screen 201 may further include a message bar 209, credit indicator 211, bet indicator 213, win indicator 215, help button 217, hint area 219, and spin button 221. Additional and/or different information may alternatively be presented, based on the design of the specific game in which aspects of the present invention are used.

Each reel 203 includes various discrete symbols or indicia, and the outcome of each game may be determined based on what indicia appear on each pay line corresponding to pay line indicators 207. The indicia used may vary based on game implementation, and may include icons, photos, graphics, clipart, artwork, drawings, numbers, letters, etc., that conform to a theme of the game. The various indicia of an illustrative embodiment, including cars, numbers, letters, bonus images, scatter images, and wild card(s), are illustrated throughout the figures. A wild card need not say "wild," but rather is treated as such by the video gaming device, e.g., indicia 701 in FIG. 7.

For reference herein, frame 205 is said to be at position A when the left most visible reel in frame 205 is reel 203*a* and the right most visible reel in frame 205 is reel 203*e*; frame 205 is said to be at position B when the left most visible reel in frame 205 is reel 203*b* and the right most visible reel in frame 205 is reel 203*f*; frame 205 is said to be at position C when the left most visible reel in frame 205 is reel 203*c* and the right most visible reel in frame 205 is reel 203*g*; frame 205 is said to be at position D when the left most visible reel in frame 205 is reel 203*d* and the right most visible reel in frame 205 is reel 203*h*; and frame 205 is said to be at position E when the left most visible reel in frame 205 is reel 203*e* and the right most visible reel in frame 205 is reel 203*i*. Reel 205 is shown in position C in FIG. 2.

In the presently illustrated embodiment, the active reels, i.e., reels encompassed by frame 205 and used to determine payouts) are located sequentially next to each other, i.e., consecutively. In an alternative embodiment the active reels need not be located sequentially, but could include any five reels selected from the available nine reels, or any N reels selected from the available M reels. In yet another illustrative embodiment, instead of the frame floating over the M reels, the frame may appear to remain stationary while reels appear to slide behind the frame, e.g., in a 5-100 embodiment where all reels are not visible at the same time.

Figure 7:
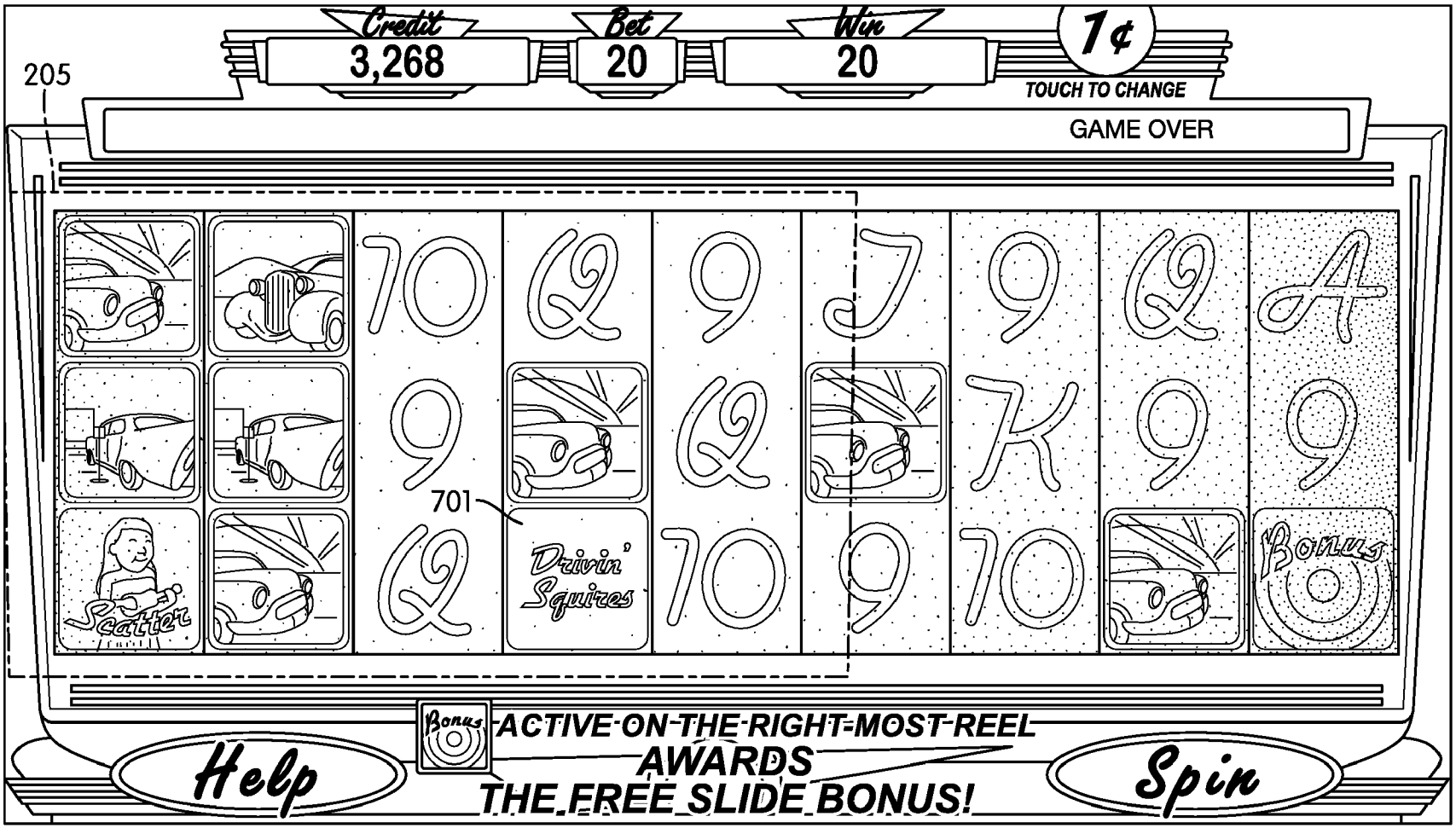
FIG. 7 illustrates a screen display of a video game of chance displaying wild card indicia and shaded reels according to an illustrative embodiment.

According to an aspect of the invention, reels on one side of the screen, e.g., reels on the left, may pay at a higher percentage, rate, and/or amount than reels on the other side of the screen, e.g., reels on the right. In addition, payout percentages, rates or amounts may decrease progressively from one side of the screen to the other, or may randomly change from one reel to the next. The payout percentage/amount per reel may be altered by a random number generated that determines the stop position of each reel, or may be altered by placing more indicia that result in higher payouts on higher paying reels, and more indicia that result in lower payouts on lower paying reels. The video gaming device may optionally vary a color gradient applied to a graphically depicted reel based on that reel's likelihood of paying as described above, e.g., as illustrated in FIG. 7, to provide a visual indication or cue to the player regarding which reels are more likely to pay than others. In one illustrative embodiment, the reels may transition from a red gradient on the left, indicating higher paying reels, to a blue gradient on the right, indicating lower paying reels, with a smooth gradual transition between red and blue as the reels progress from higher paying to lower paying status. Other visual cues may alternatively be used.

Figure 3:
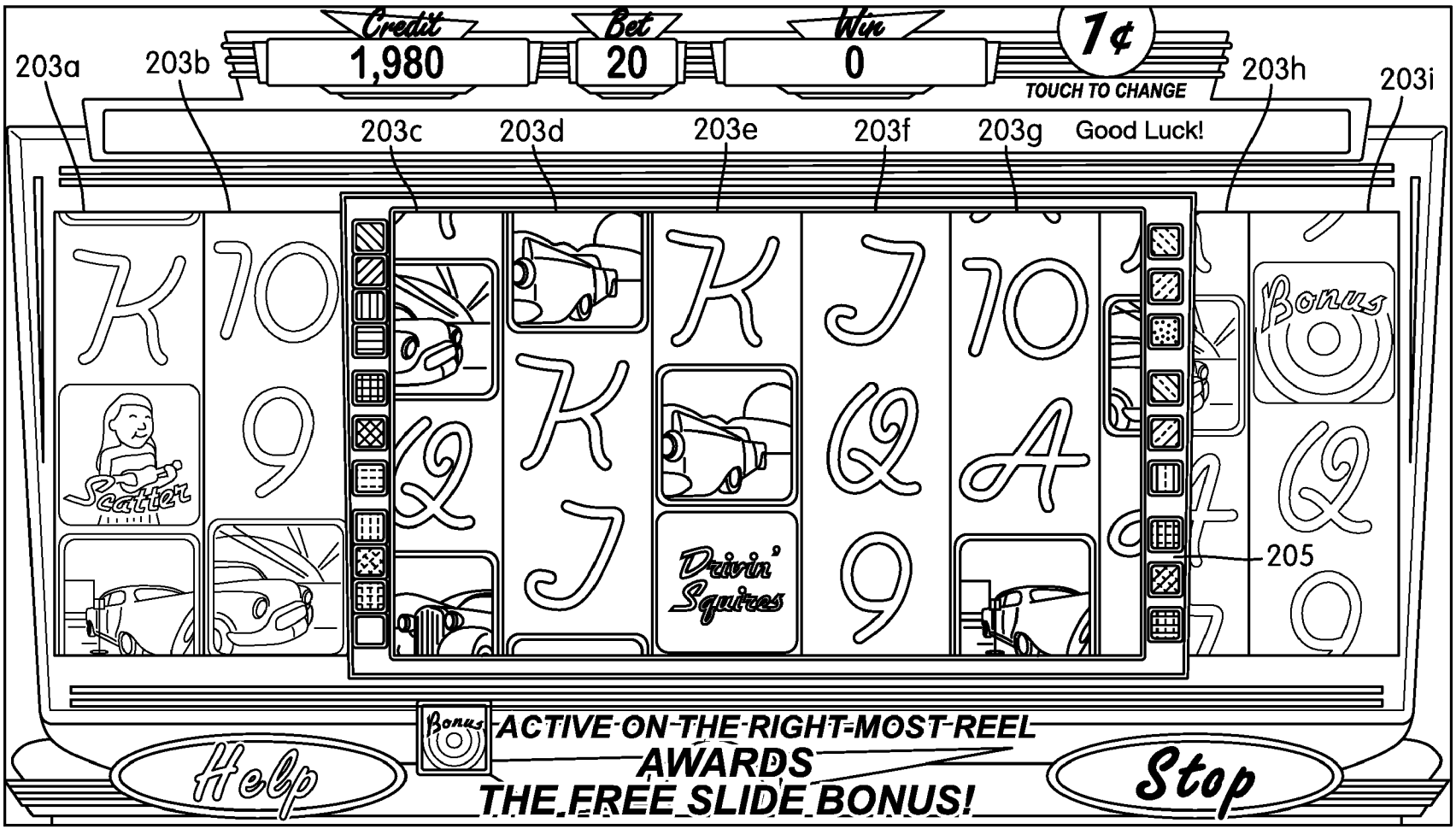
FIG. 3 illustrates a screen display of a video game of chance during an animation sequence according to an illustrative embodiment.
Figure 4:
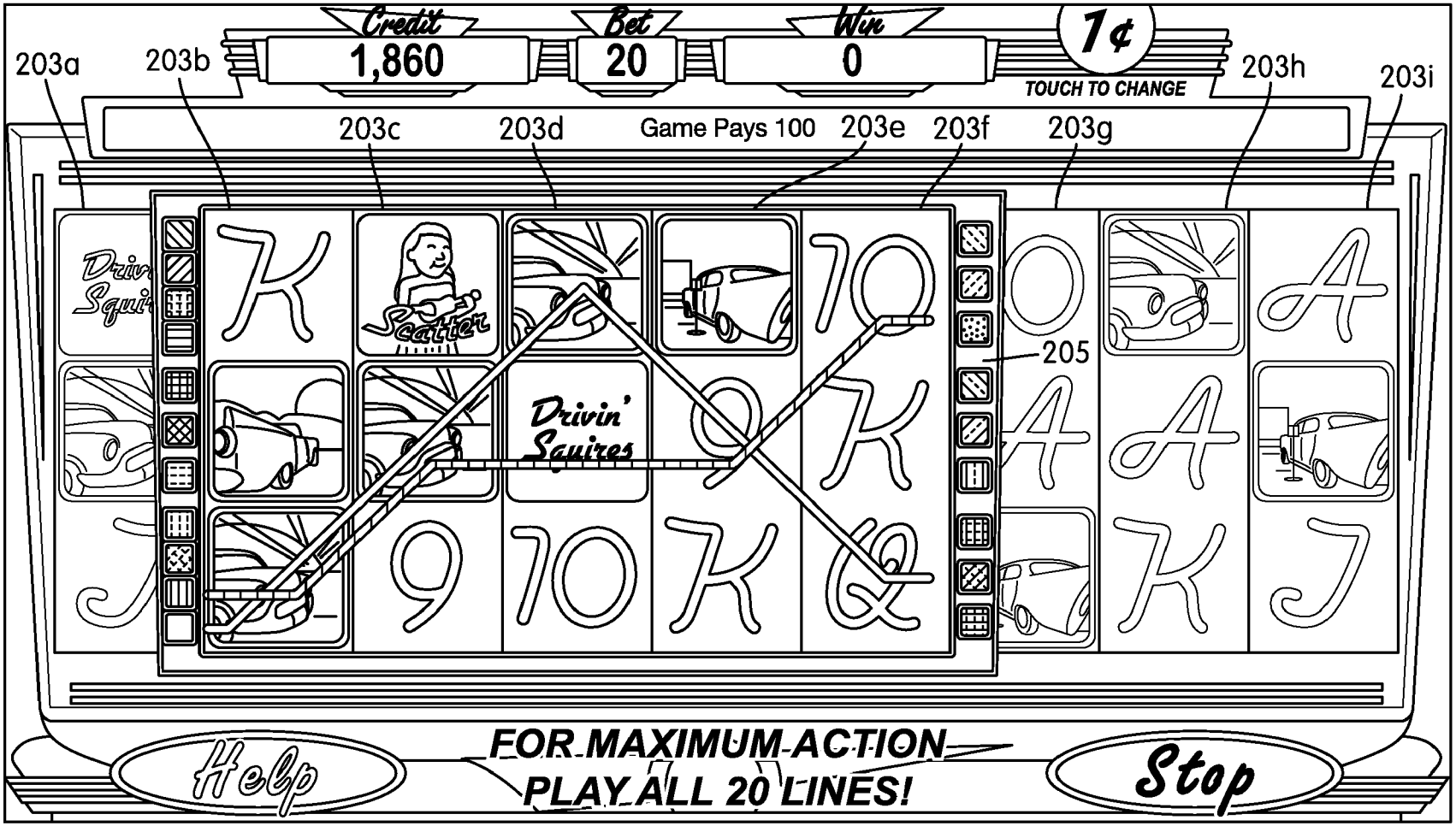
FIG. 4 illustrates a screen display of a video game of chance providing pay line indicators according to an illustrative embodiment.

With reference to FIGS. 3-4, according to one or more illustrative aspects, game play may be similar to a N-N line based video slot game, e.g., a 5 line video slot game, with the addition of the selection of active reels from a greater number of available reels, the differentiation of higher and lower paying reels, and/or bonus game possibilities made possible by the existence of more reels than are needed to determine the outcome of a game. The player may select the number of lines 207 to play and the bet per line. When the game is initiated, all nine reels 203*a*-203*i* begin spinning and five-reel-wide game frame 205 begins to slide left and right, as shown in FIG. 3. In FIG. 3, the frame 203 is not shown in any specific position A-E, but rather is shown in a moving or animated state, as evidenced by the frame including a portion of six different reels 203*c*-203*h* and by the indicia on the reels being unaligned. As indicated above, the frame may stop randomly on any one of the 5 left to right positions A-E, and then the reels stop. Alternatively, the frame may have a higher likelihood of stopping on higher paying reels or lower paying reels based on a player's wager, or based on a casino's desired payout percentage. FIG. 4 illustrates frame 205 having stopped in position B. The game may then pay all line wins, also illustrated in FIG. 4. Symbols that fall outside of the 5-reel-wide game frame are inactive and do not contribute to game pays, except as otherwise indicated herein (e.g., as a bonus and/or a scatter).

Figure 5:
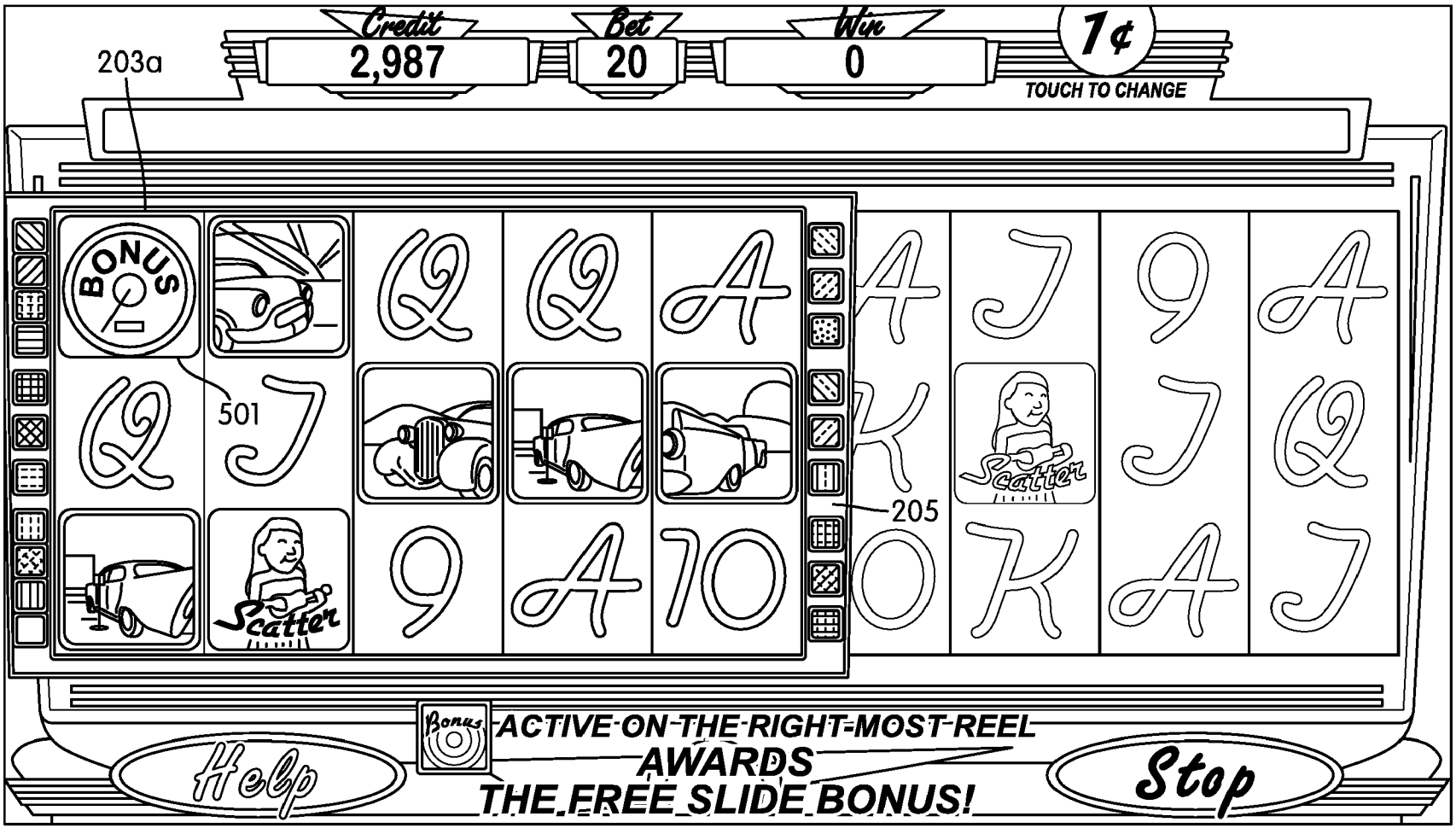
FIG. 5 illustrates a screen display of a video game of chance displaying spin bonus indicia according to an illustrative embodiment.

Further illustrative aspects of the invention may include one or more bonus rounds that utilize some or all of the additional reels provided in accordance herein. With reference to FIG. 5, according to an illustrative aspect, a predetermined reel (e.g., the left most reel 203*a*) may include a bonus initiator symbol 501 that, when appearing on the predetermined reel and that reel is active (i.e., encompassed within frame 205), the game enters a spin bonus mode. In the spin bonus mode, the game frame locks on its current position (here, position A), the video gaming device spins some predetermined number of free spins, e.g., five free spins, and calculates payouts based on each free spin and awards the payouts to the player. Payouts may include additional free spins. Alternatively, frame 205 may move randomly or a predetermined amount after each free spin, e.g., over one reel, until the player has received one free spin for each possible position of frame 205 or has reached some other predetermined condition for ending the spin bonus.

Figure 6:
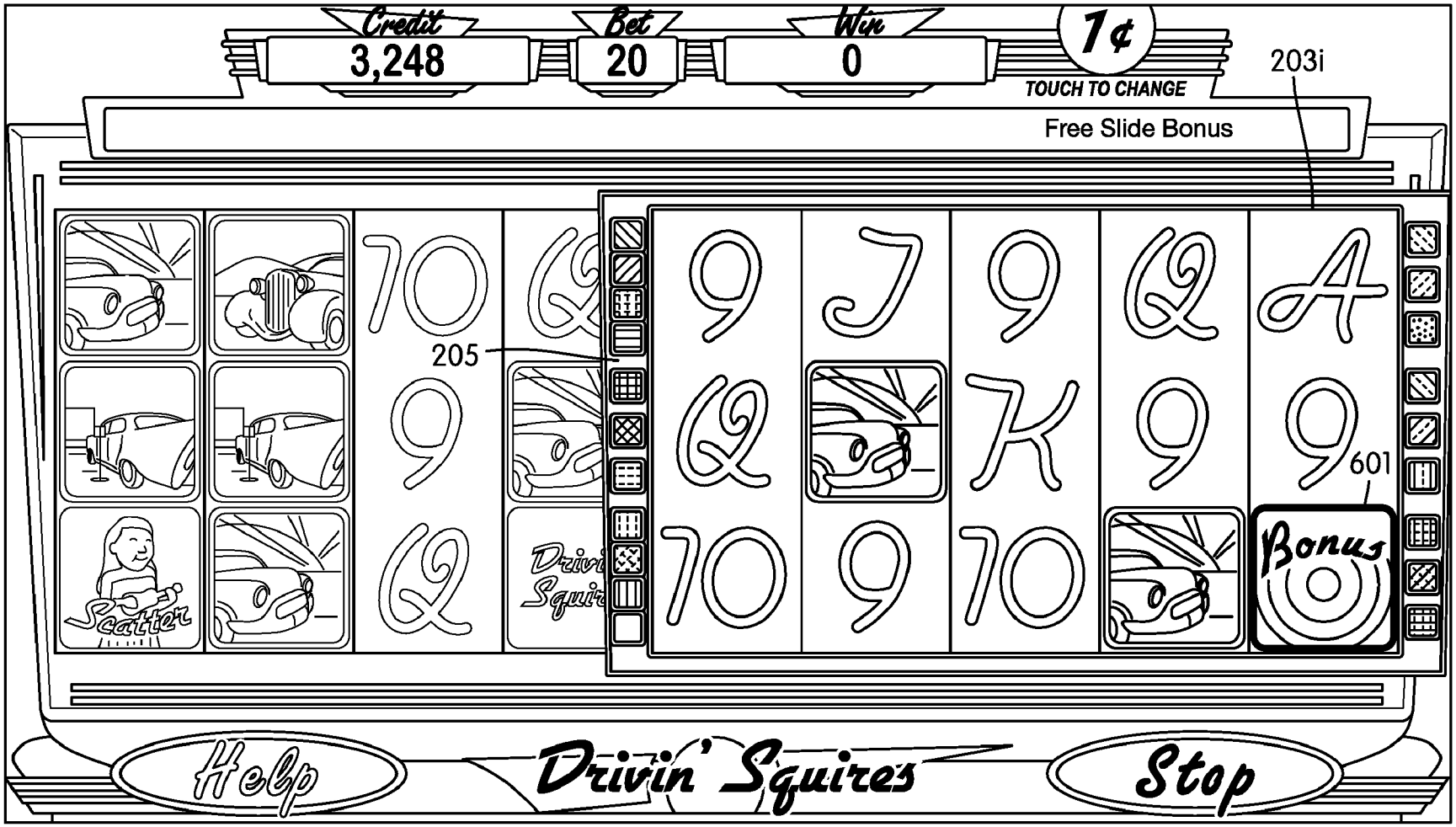
FIG. 6 illustrates a screen display of a video game of chance displaying slide bonus indicia according to an illustrative embodiment.

With reference to FIG. 6, in yet another embodiment, a predetermined reel (e.g., the right most reel 203*i*) may include a bonus initiator symbol 601 that, when it appears on the reel and the reel is active, the game pays as normal but enters a slide bonus mode. In the slide bonus mode, after completion of determining normal payouts, video gaming device 101 (FIG. 1) moves frame 205 left one reel (from position E to position D), and video gaming device 101 computes payouts based on the new position of frame 205, and then repeats. That is, video gaming device 101 moves frame 205 through each position and calculates payouts to the player based on each frame position E-A, without respinning the reels.

The slide bonus and spin bonus may be triggered based on any predetermined indicia appearing on one or more predetermined reels, and may proceed left to right, right to left, randomly, for some predetermined or random period, a predetermined or random number of spins, a predetermined or random number of frame changes, or the like. During the bonus mode, the video gaming device may optionally use different indicia than are used during normal game play, thereby providing altered game play and/or other visual cues during a bonus mode.

Other bonus modes may be included. According to an illustrative aspect, an alternative bonus, referred to herein as a "best-win" bonus, may award one or more free spins with the highest paying frame position (instead of a random or fixed position) chosen for each spin. For example, when some predetermined indicia or combination of predetermined indicia appear in a specific location and/or pattern, a best-win bonus may be awarded to the player. In the best-win bonus mode the player is awarded some number of free spins. After each free spin, the frame is placed at/moved to the highest paying position for that spin, the slot machine calculates line wins and/or other payout based on information in the pay-table ROM, and awards/credits the player as applicable (or adds up all free spin awards and awards/credits the player after the conclusion of the best-win bonus). For example, in the illustrative 5-9 embodiment, the machine calculates which of the 5 frame positions has the highest payout based on the lines or wagering style being played, and then moves the frame to the position that has the highest payout. The determination of which frame position has the highest payout could change, e.g., if the payout of various reels changes from one spin to the next. The number of awarded free spins may be some predetermined number, or may be based on other criteria (e.g., random, user selection of one of some number of hidden choices displayed on the display screen of the slot machine, etc.).

According to another illustrative aspect, an alternative bonus, referred to herein as an "all pay" bonus, may award one or more free spins where every spin pays at every frame position (combination of the spin and slide bonuses).

Figure 8:
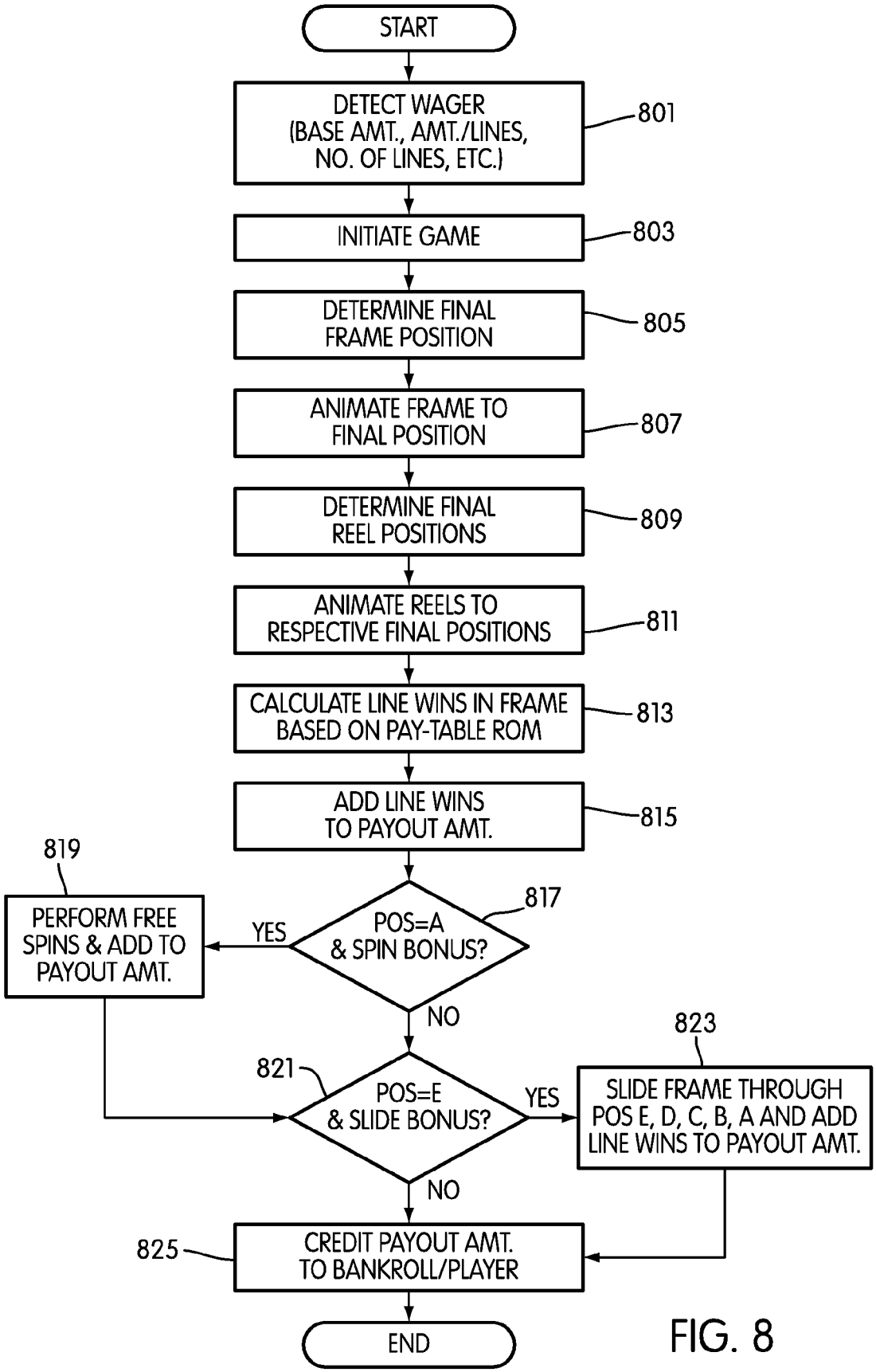
FIG. 8 is a flow chart for a method of performing a video game of chance according to an illustrative embodiment.
Figure 9:
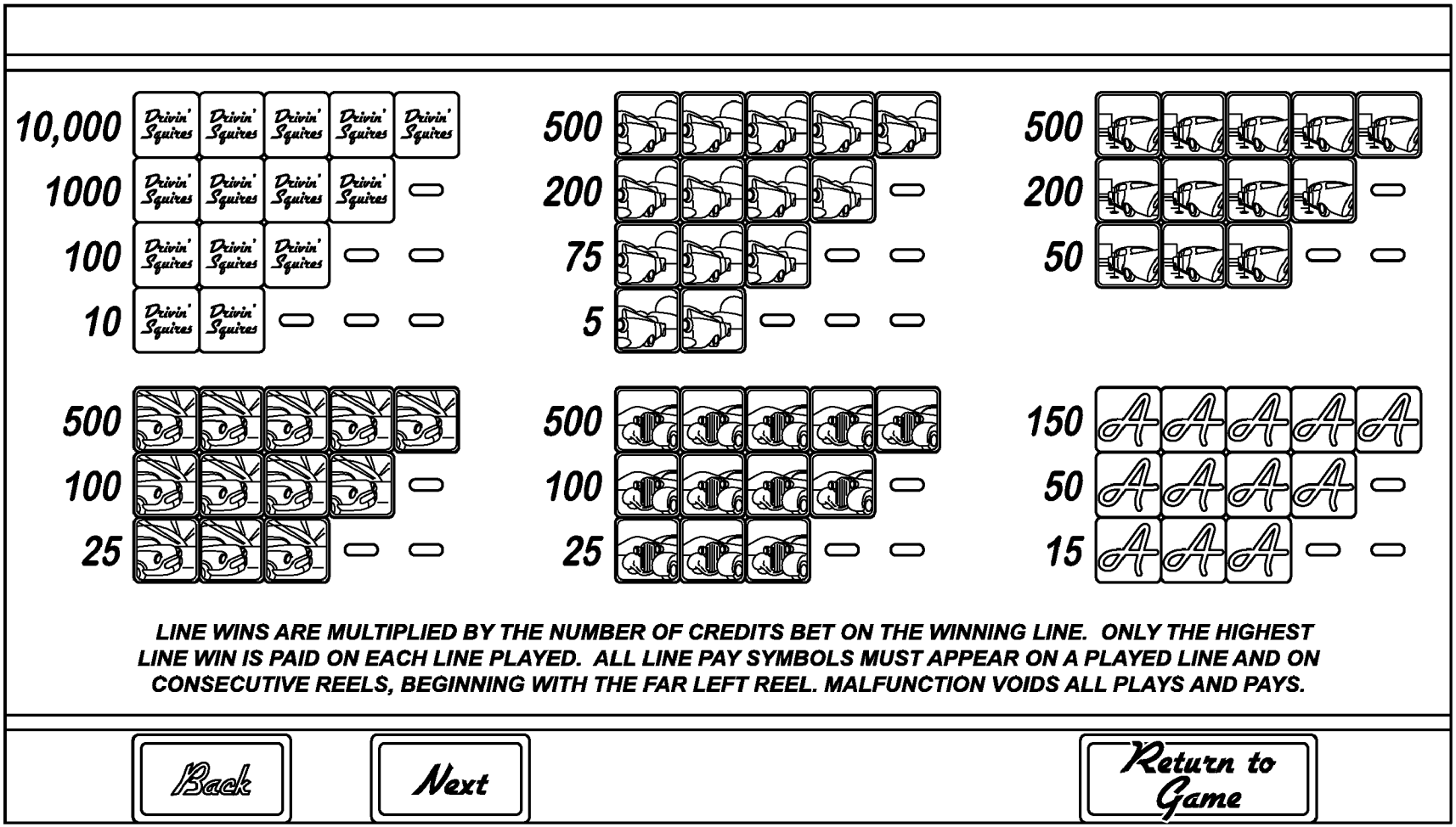
FIG. 9 illustrates a help/payout screen display of a video game of chance according to an illustrative embodiment.
Figure 10:
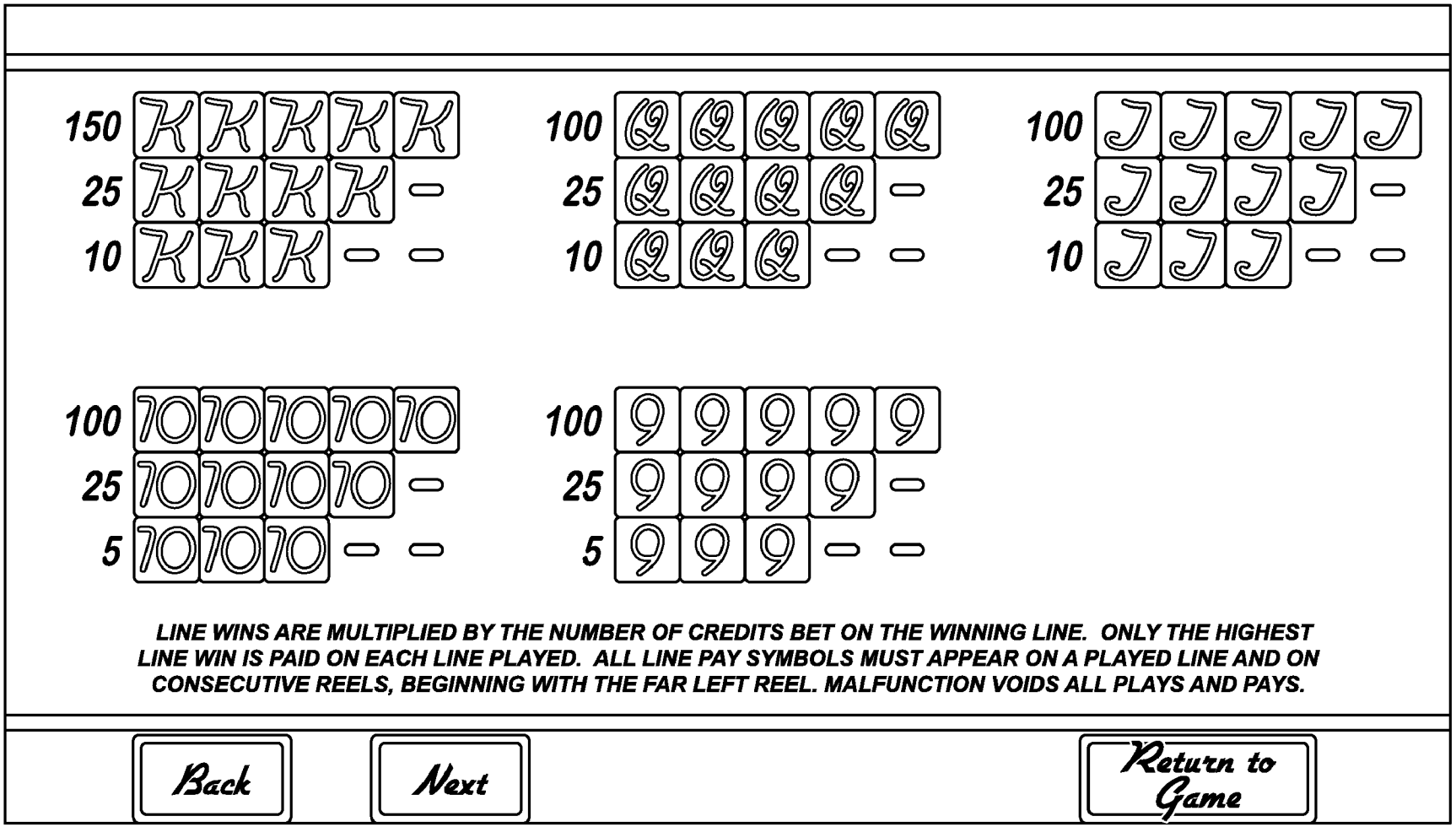
FIG. 10 illustrates a help/payout screen display of a video game of chance according to an illustrative embodiment.
Figure 11:
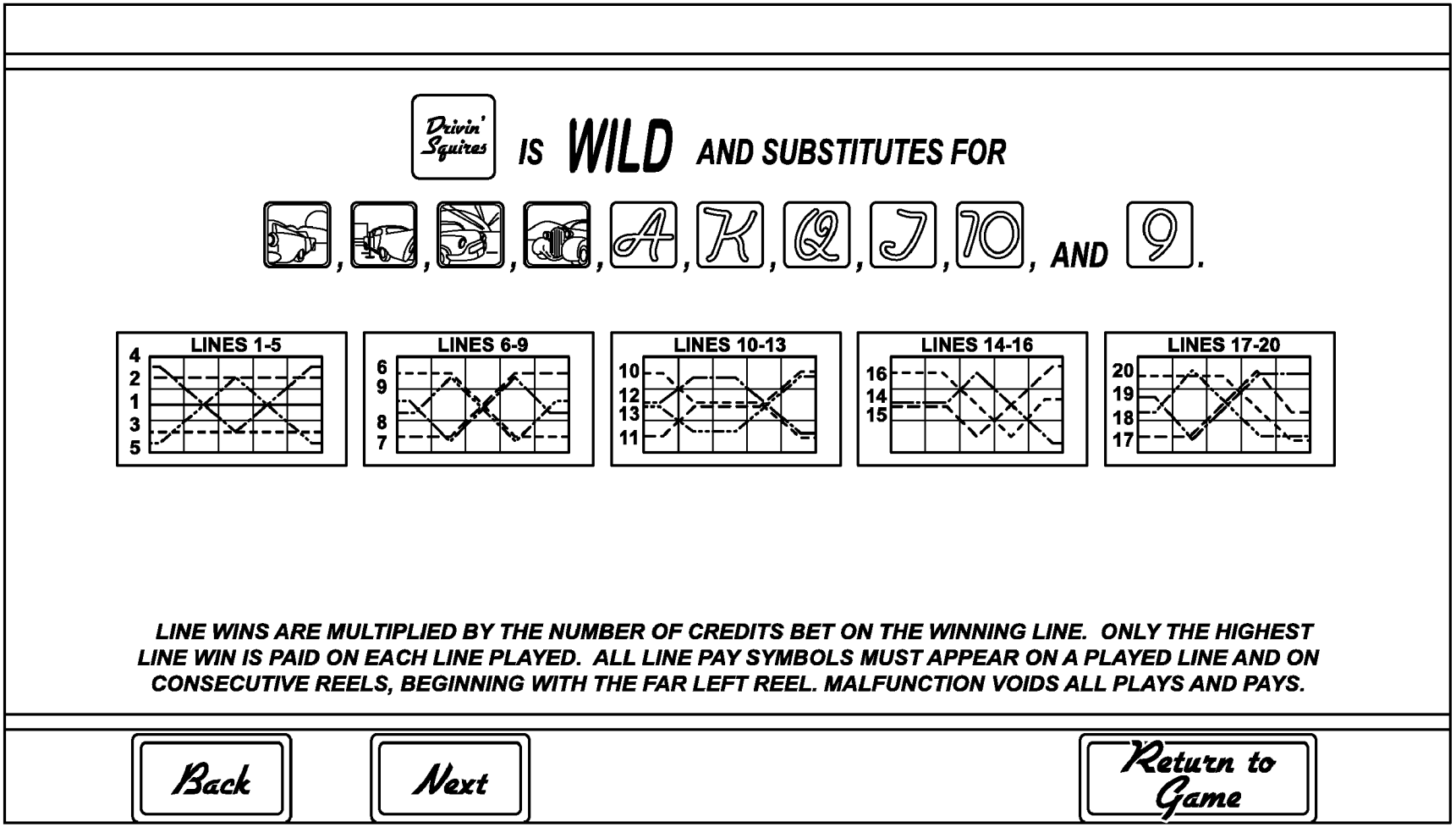
FIG. 11 illustrates a help/payout screen display of a video game of chance according to an illustrative embodiment.
Figure 12:
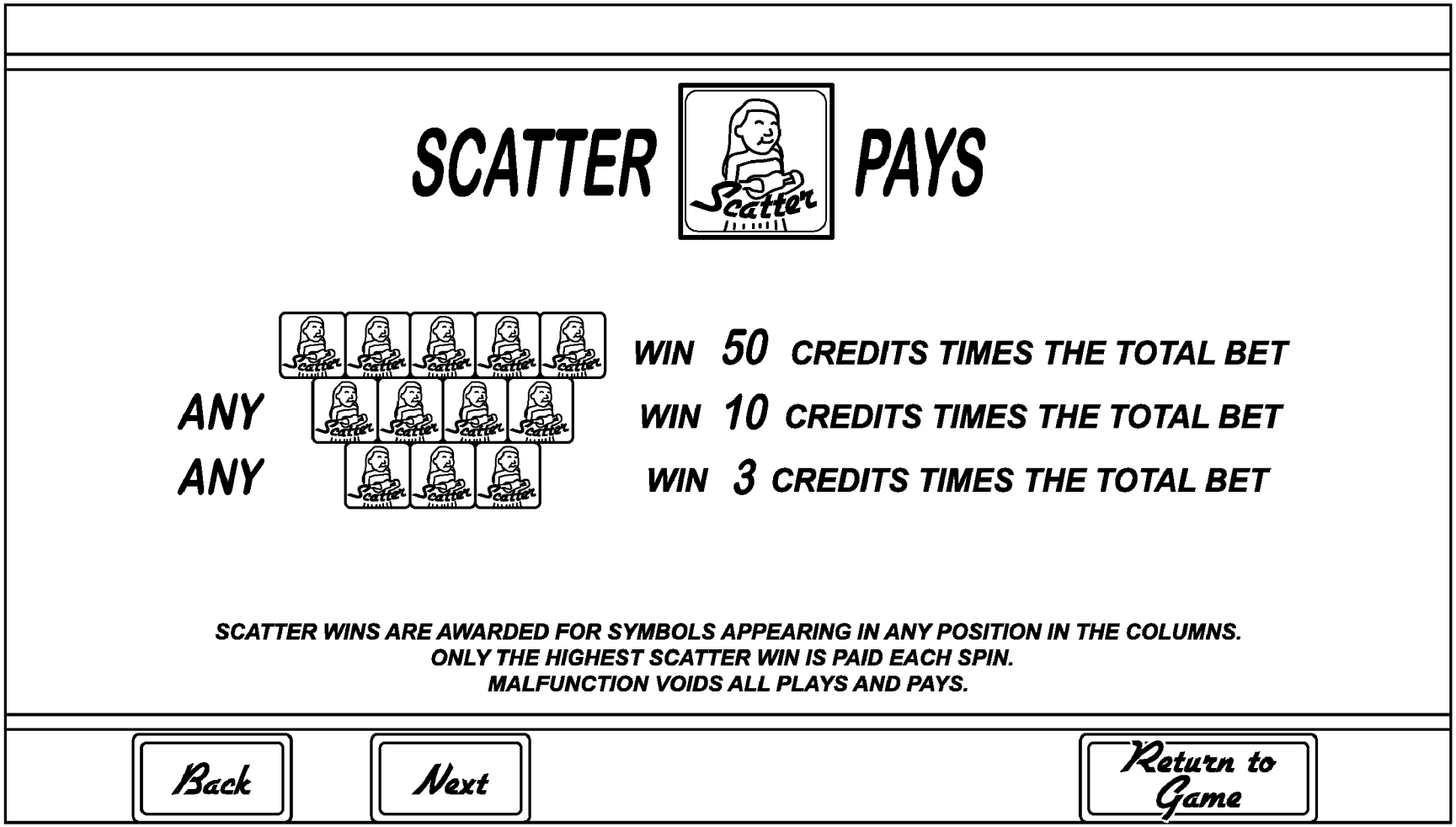
FIG. 12 illustrates a help/payout screen display of a video game of chance according to an illustrative embodiment.
Figure 13:
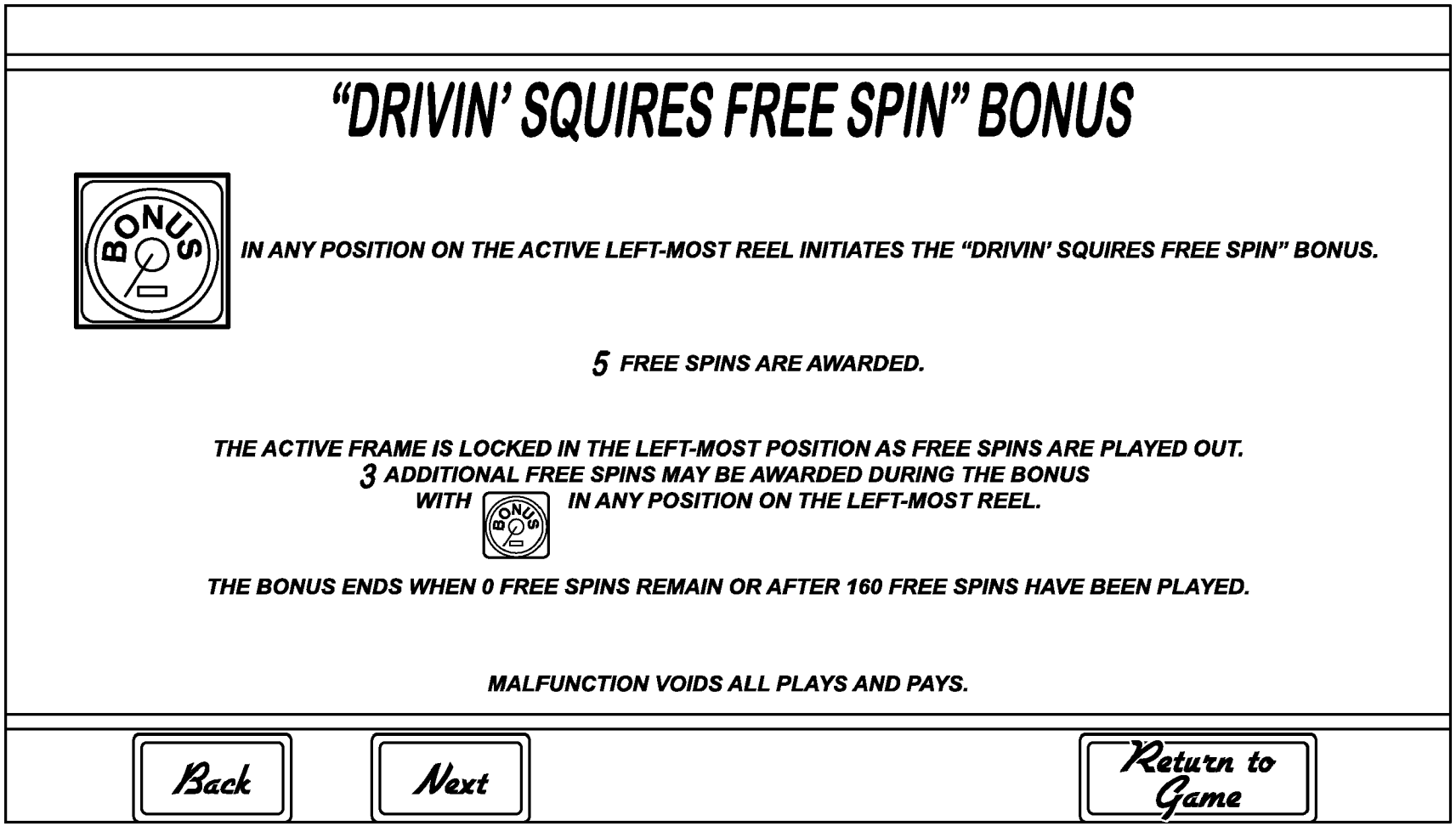
FIG. 13 illustrates a help/payout screen display of a video game of chance according to an illustrative embodiment.
Figure 14:
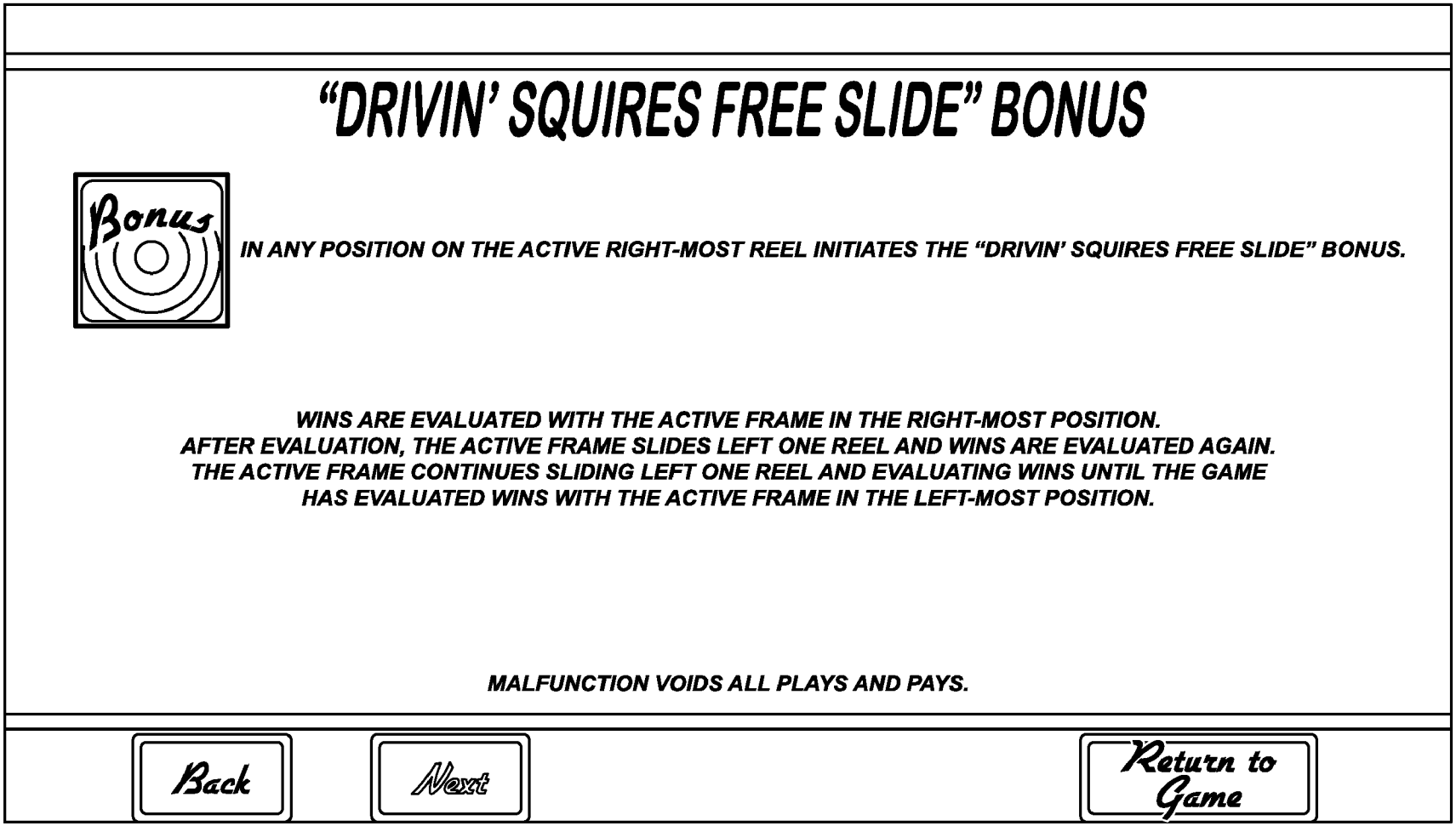
FIG. 14 illustrates a help/payout screen display of a video game of chance according to an illustrative embodiment.

FIG. 8 illustrates a flow chart of a method for performing one or more aspects of the invention according to an illustrative embodiment. Initially, in step 801, video gaming device 101 (FIG. 1) detects a player wager, including a base wager amount, a wager amount per line or multiplier per line, and a selected number of lines. The base wager amount B may vary depending on the video gaming device, or may be selectable by the player. For example, a base wager amount B may be \$0.01 per line, \$0.02 per line, \$0.05 per line, \$0.10 per line, \$0.25 per line, \$0.50 per line, \$1.00 per line, or some other amount. The base wager B may also be referred to as the value of one game credit. The wager amount/multiplier per line M refers to how many game credits the player desires to wager per line, e.g., 1 credit, 2 credits, 5 credits, 10 credits, etc. The selected number of lines L refers to how many of the available lines represented by line indicators 207 the player desires to play, e.g., one line, two lines, three lines, four lines . . . max number of lines, etc. The player may be able to select any arbitrary number of lines, or may be required to choose between predetermined amounts of lines. The video game device in step 801 then calculates the total wager as B×M×L, and in step 803 the video gaming device initiates a game, e.g., responsive to the player selecting a "spin" button or the like.

In steps 805 and 807 video gaming device 101 determines the final position of frame 205, and animates frame 205 as moving back and forth over the M reels, then coming to a rest at the determined final position. Concurrently with steps 805-807 (or at least appearing concurrently), video gaming device 101 in steps 809 and 811 determines the final position of each reel 203*a*-203*i*, and animates the reels as appearing to spin and then come to a rest at their respectively determined final positions. Video gaming device 101 may visually depict each reel stopping simultaneously, or may stagger the order in which the reels appear to stop. Step 805 may be performed before or after the beginning of step 807; and step 809 may be performed before or after the beginning of step 811.

Video gaming device 101 in step 813 calculates line wins for each line wagered by the player, based on the indicia visible on the active reels, i.e., the reels located within frame 205, based on information stored in pay-table ROM 107. For purposes of illustration only, FIGS. 9-14 illustrate help/instructional information including the payout information that may be stored in pay-table ROM 107. The information in FIGS. 9-14 is illustrative only. As used herein, pay-table ROM 107 may define any desired type of payout criteria, including multi-way payouts, left-to-right line payouts, right-to-left line payouts, scatter payouts, bonus payouts, or any other type of payout based on the field of indicia and the frame overlying a portion thereof.

Upon calculating the line wins based on the frame and reel positions, video gaming device 101 in step 815 adds the line wins to the payout amount, e.g., to a payout amount variable stored in a volatile or non-volatile memory of device 101.

In optional steps 817-823, video game device determines whether the indicia in the active frame meet any predetermined criteria to provide any bonus mode(s) to the player. For example, in step 817, video gaming device 101 determines whether a spin bonus mode condition is met, e.g., frame 205 is in position A and spin bonus indicia 501 is present in reel 203*a*. If the spin bonus condition is met, then in step 819 video gaming device 101 performs the spin bonus (described above) and adds any payouts from the spin bonus to the payout amount.

In step 821 the video gaming device 101 may determine whether a slide bonus condition is met, e.g., frame 205 is in position E and slide bonus indicia 601 is present in reel 203*i*. If the slide bonus condition is met, then in step 823 video gaming device 101 performs the slide bonus (described above) and adds any payouts from the slide bonus to the payout amount. The video gaming device in step 825 credits the total payout amount (including line wins and bonus wins) to the player. The credit may take the form of a cash payout to the player, or may alternatively be in the form of a credit or voucher. In yet another alternative, the video gaming device 201 may store in memory a running tally of credits available to the player, and may add the total payout amount to the running tally, which the player can cash out at his or her leisure.

Embodiments and aspects of the method described above may vary. Steps may be performed other than in the recited order (e.g., steps 805-807 and steps 809-811—frame and reel animations may be swapped), steps may be combined, steps may be split into multiple steps performed in sequence or separated by one or more other steps, and some steps may be optional (e.g., steps 817-823).

The methods and systems described herein may be adapted for embodiments other than the 5-9 embodiment described herein including, but not limited to, 2-4, 3-5, 4-7, and 5-100 embodiments. In addition, the methods and systems described herein may be adapted for embodiments other than in a 3-symbol/indicia high slot machine. For example, aspects described herein may be used on a 6-10 embodiment of a 4×6 slot game. That is, the frame may be any width, height, and/or shape (e.g., non-rectangular shapes may be used).

Figure 15:
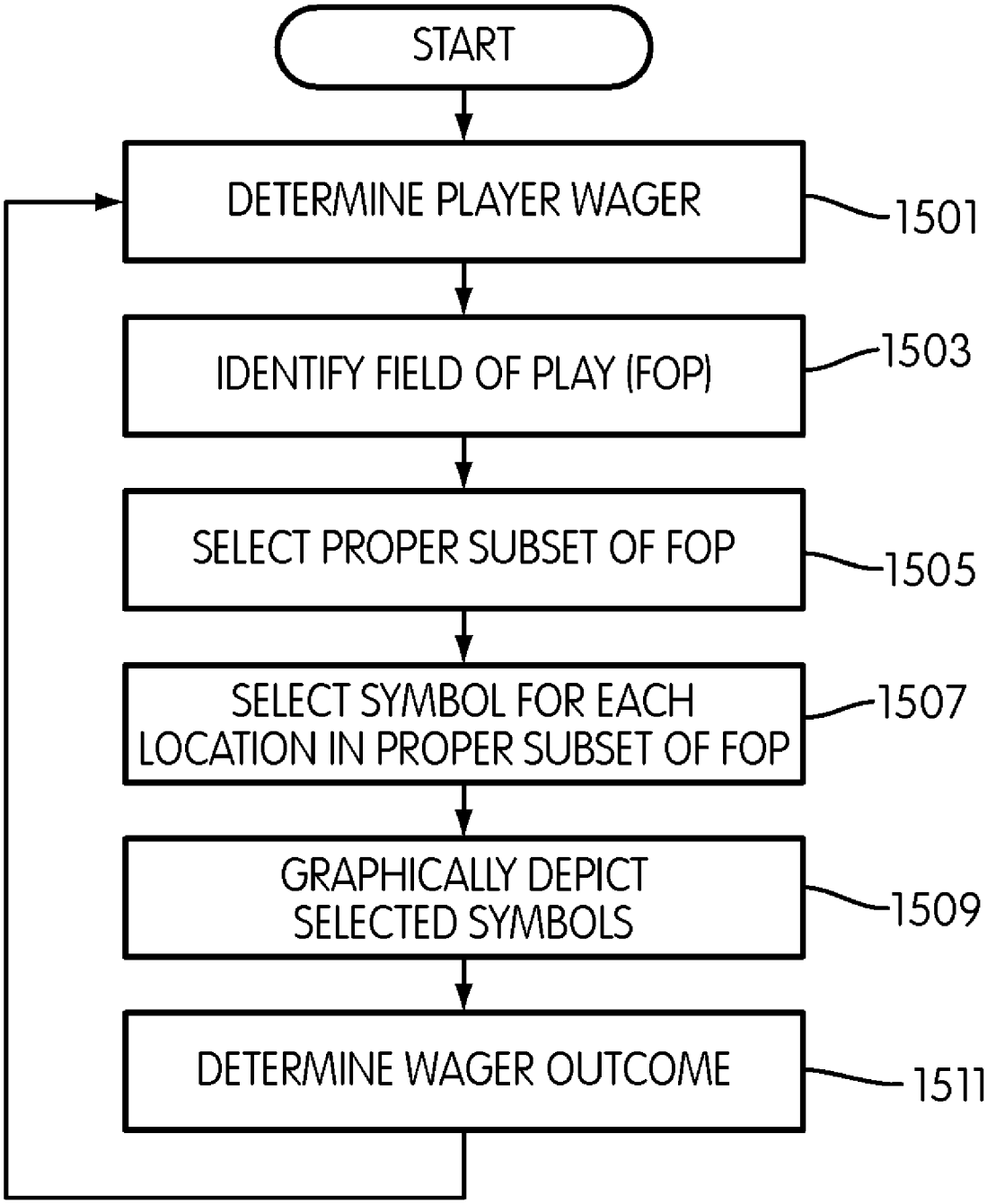
FIG. 15 illustrates a method of play for a video slot machine according to one or more illustrative aspects described herein.

With further reference to FIG. 15, an aspect of the invention may provide a computer readable medium, video slot machine, and/or corresponding method that determine a wager outcome of a video slot machine based on only a portion of an entire field of play of the slot machine. A representative method may perform a video slot gaming method by identifying a field of play of a video slot machine (step 1503), where the field of play comprises a plurality of field locations, and where each field location is configured to host at least one symbol selected from a predefined set of symbols. The slot machine method determines a wager by a player of the video slot machine (step 1501), automatically selects a proper subset of the field locations (step 1505) and, for each field location of the proper subset of field locations, quasi-randomly selects a symbol from the predefined set of symbols to be hosted by the field location (step 1507). The slot machine graphically depicts each field location of the proper subset of field locations as hosting its corresponding selected symbol on a display of the video slot machine (step 1509), and the slot machine determines a wager outcome based on the symbols hosted by each field location of the proper subset of the field locations (step 1511). As used herein, quasi-randomly refers to the fact that true randomness may never be achieved, but is encompassed within the scope herein, and also that the random selection may be weighted based on one or more criteria such as a payout rate of a slot machine, player wager amount, etc.

Multiple frames may be used concurrently to provide a multi-game variant. Also, the width, height, and/or shape of the frame may vary as additional rows or columns (or other field locations) are purchased or won, or the range of reels being played may vary as reels are purchased or won. In addition, the playing field need not necessarily be defined by reels, but could encompass any field of play larger than a frame identifying a subset of the field where the symbols in the frame are used to determine the payout or outcome of the game. For example, the field of play may include multiple dice arranged in a predefined configuration (e.g., rectangular, pyramid, etc), and the frame may encompass a proper subset of the dice.

The frame may move up, down, diagonally, or some other predetermined or random movement. Where the symbol field is taller than the frame, the frame may move in both horizontal and vertical directions. Where the symbol field is three dimensional or in a simulated three-dimensional environment, the frame may slide or move in the z-axis (i.e., toward and away from the player). In such an environment, higher paying reels may be along the z-axis instead of the x- or y-axis. A player of a slot machine or video gaming device may be given some level of control to stop the frame from moving (e.g., by sliding, appearing randomly, jumping, etc.)

According to other alternatives, symbols/indicia outside of the frame may be active in some manner, e.g., to determine scatter wins and bonus initiators. Paylines may alternatively be positioned at the edges of the outer-most reels rather than being attached to the frame, or might not be included at all. Paylines may traverse across all reels, and the slot machine pays based on the portion of each payline that lies within the frame. As indicated above, the information in FIGS. 9-14 is illustrative only. Paylines, payouts, and outcomes are determined by pay-table ROM 107, which may define any desired type of payout criteria (e.g., multi-way payouts, left-to-right line payouts, right-to-left line payouts, scatter payouts, bonus payouts, etc.) based on the field of play and the selected proper subset thereof.

Meters, multipliers, displays, sound, and animations may be unique to one or more aspects described herein. For example, one or more illustrative embodiments may include a reel position meter, a multiplier corresponding to a frame position, a multiplier corresponding to a reel, position pay percentage meter, width and height of sliding frame meter (if variable), colored or designed overlays over inactive symbols or reels (e.g., based on pay percentage), frame position dependent animations to display high or low pay percentage positions, and/or audio cues for high and low pay percentage frame positions.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A method comprising:

receiving a line input in a slot machine, wherein the line wager comprises a number of lines and a wager amount per line;

graphically depicting a M-reel game on a display of the slot machine, where $M \geqq 2$, wherein each reel comprises a plurality of discrete indicia, a subset $m>1$ of the plurality of discrete indicia being displayed when the reel is at rest;

automatically selecting N consecutive reels from the M reels, where 1<N<M;

spinning at least each of the graphically depicted N reels on the display of the slot machine;

determining a final position corresponding to each of the N reels;

stopping each of the graphically depicted N reels at the corresponding final position;

determining a payout outcome of the game based on the line wager and based on a comparison of the indicia displayed on each of the selected n reels to a predefined pay-table;

wherein automatically selecting N consecutive reels from the M reels comprises:

determining a final position of an N-reel wide frame, the N-reel wide frame having a height sufficient to display the subset m of the discrete indicia;

graphically depicting the N-reel wide frame moving back and forth over the M reels during a period while the at least each of the graphically depicted N reels on the display of the slot machine are spinning; and then stopping the N-reel wide frame at the determined final position of the N-reel wide frame.

2. The method of claim 1, wherein N=5 and M=9.

3. The method of claim 2, wherein a pay rate of each of the M reels progressively increases from a first of the graphically depicted M-reels to a last of the graphically depicted M-reels.

4. The method of claim 1, wherein a pay rate varies among the M reels.

5. The method of claim 1, wherein determining the final position of the N-reel wide frame is based on any wager of the player.

6. The method of claim 1, further comprising, when a predetermined indicia appears on a stopped predetermined reel and the stopped predetermined reel is within the frame, performing a bonus mode comprising:

moving the frame to at least one additional frame position without respinning the M-reels;

determining a frame payout corresponding to each additional frame position based on the line wager and based on a comparison of the indicia displayed on each of the N reels within each frame position to the predefined pay-table; and adding the frame payout corresponding to each additional frame position to the payout outcome.

7. The method of claim 6, wherein the predetermined stopped reel comprises one of a first reel and a last reel graphically depicted on the display, and the at least one additional frame position comprises all possible frame positions in addition to the final determined position of the N-reel frame.

8. The method of claim 1, further comprising, when a predetermined indicia appears on a stopped predetermined reel and the stopped predetermined reel is within the frame, performing a bonus mode comprising:

locking the frame in the final determined position of the N-reel frame for a predetermined number of free spins;

determining a spin payout corresponding to each free spin based on the line wager and based on a comparison of the indicia displayed on each of the selected N reels to the predefined pay-table; and adding the spin payout corresponding to each free spin to the payout outcome.

9. The method of claim 8, wherein the predetermined stopped reel comprises one of a first reel and a last reel graphically depicted on the display.

10. The method of claim 1, further comprising, when a set of one or more predetermined indicia appear in a predetermined pattern on one or more stopped reels, performing a bonus mode comprising:

awarding a predetermined number of free spins;

positioning the frame at a highest paying position for each free spin;

determining a spin payout corresponding to each free spin based on the line wager and based on a comparison of the indicia displayed on each of the N reels displayed within the frame to the predefined pay-table; and adding the spin payout corresponding to each free spin to the payout outcome.

11. A slot machine, comprising:

an input system for receiving a line wager from a player, said line wager comprising a number of lines and a wager amount per line;

a video output display;

a processor controlling overall operations of the video gaming device to perform a method in accordance with executable instructions stored in one or more memories, said method comprising:

graphically depicting a M-reel game on the video output display of the slot machine, where M≧2, wherein each reel comprises a plurality of discrete indicia, a subset m>1 of the plurality of discrete indicia being displayed when the reel is at rest;

automatically selecting N consecutive reels from the M reels, where 1<N<M, spinning at least each of the graphically depicted N reels on the display of the slot machine, determining a final position corresponding to each of the N reels, stopping each of the graphically depicted N reels at the corresponding final position, crediting a payout outcome of the game to a player based on the line wager and based on a comparison of the indicia displayed on each of the selected N reels to a predefined pay-table;

wherein automatically selecting N consecutive reels from the M reels comprises:

determining a final position of an N-reel wide frame, the N-reel wide frame having a height sufficient to display the subset m of the discrete indicia;

graphically depicting the N-reel wide frame moving back and forth over the M reels during a period while the at least each of the graphically depicted N reels on the display of the slot machine are spinning; and then stopping the N-reel wide frame at the determined final position of the N-reel wide frame.

12. The slot machine of claim 11, wherein N=5 and M=9.

13. The slot machine of claim 12, wherein a pay rate of each of the M reels progressively increases from a first of the graphically depicted M-reels to a last of the graphically depicted M-reels.

14. The slot machine of claim 11, wherein a pay rate of each of the M reels progressively increases from a first of the graphically depicted M-reels to a last of the graphically depicted M-reels.

15. The slot machine of claim 11, wherein determining the final position of the N-reel wide frame is based on any wager of the player.

16. The slot machine of claim 11, said method further comprising, when a predetermined indicia appears on a predetermined stopped reel within the frame, performing a bonus mode comprising:

moving the frame to at least one additional frame position without respinning the M-reels;

determining a frame payout corresponding to each additional frame position based on the line wager and based on a comparison of the indicia displayed on each of the N reels within each frame position to the predefined pay-table; and adding the frame payout corresponding to each additional frame position to the payout outcome.

17. The slot machine of claim 16, wherein the predetermined stopped reel comprises one of a first reel and a last reel graphically depicted on the display, and the at least one additional frame position comprises all possible frame positions in addition to the final determined position of the N-reel frame.

18. The slot machine of claim 11, said method further comprising, when a predetermined indicia appears on a predetermined stopped reel within the frame, performing a bonus mode comprising:

locking the frame in the final determined position of the N-reel frame for a predetermined number of free spins;

determining a spin payout corresponding to each free spin based on the line wager and based on a comparison of the indicia displayed on each of the selected N reels to the predefined pay-table; and adding the spin payout corresponding to each free spin to the payout outcome.

19. The slot machine of claim 18, wherein the predetermined stopped reel comprises one of a first reel and a last reel graphically depicted on the display.

20. The slot machine of claim 11, said method further comprising, when a set of one or more predetermined indicia appear in a predetermined pattern on one or more stopped reels, performing a bonus mode comprising:

awarding a predetermined number of free spins;

positioning the frame at a highest paying position for each free spin;

determining a spin payout corresponding to each free spin based on the line wager and based on a comparison of the indicia displayed on each of the N reels displayed within the frame to the predefined pay-table; and adding the spin payout corresponding to each free spin to the payout outcome.

21. One or more non-transitory computer readable media storing computer executable instructions that, when executed, perform a slot machine method, comprising:

receiving a line wager from a player of the slot machine, wherein the line wager comprises a number of lines and a wager amount per line;

graphically depicting a nine-reel slot game on a display of the slot machine, wherein each reel comprises a plurality of discrete indicia, a subset m>1 of the plurality of discrete indicia being displayed when the reel is at rest;

determining a final position corresponding to each of the nine reels;

spinning each of the graphically depicted nine reels on the display of the slot machine;

stopping each of the graphically depicted nine reels at the corresponding final position;

automatically determining a final position of a five-reel wide frame, the five-reel wide frame having a height sufficient to display the subset m of the discrete indicia;

graphically depicting the five-reel wide frame moving back and forth over the nine reels while each of the graphically depicted nine reels on the display of the slot machine are spinning;

stopping the five-reel wide frame at the determined final position of the five-reel wide frame;

determining a payout outcome of the game based on the line wager and based on a comparison of the indicia displayed on each of the selected five reels to a predefined pay-table;

when a first predetermined indicia appears on a stopped first predetermined reel and the first predetermined reel is within the frame, performing a slide bonus mode comprising:

moving the frame to at least one additional frame position without respinning the nine-reels, determining a frame payout corresponding to each additional frame position based on the line wager and based on a comparison of indicia displayed on each of the five reels within each frame position to the predefined pay-table, and adding the frame payout corresponding to each additional frame position to the payout outcome;

when a second predetermined indicia appears on a stopped second predetermined reel and the second predetermined reel is within the frame, performing a spin bonus mode comprising locking the frame in the final determined position of the five-reel frame for a predetermined number of free spins, determining a spin payout corresponding to each free spin based on the line wager and based on a comparison of the indicia displayed on each of the selected five reels to the predefined pay-table, and adding the spin payout corresponding to each free spin to the payout outcome;

and crediting the payout outcome to the player.

* * * * *